US006226868B1

(12) United States Patent
Fujino

(10) Patent No.: US 6,226,868 B1
(45) Date of Patent: May 8, 2001

(54) CONNECTOR FOR FUEL INJECTION NOZZLE AND METHOD OF PRODUCING THE SAME

(75) Inventor: Hitoshi Fujino, Koga (JP)

(73) Assignee: Sanoh Kogyo Kabushiki Kaisha, Ibaraki-Ken (JP)

( * ) Notice: Subject to any disclaimer, the term of this patent is extended or adjusted under 35 U.S.C. 154(b) by 0 days.

(21) Appl. No.: 09/416,847

(22) Filed: Oct. 12, 1999

Related U.S. Application Data

(62) Division of application No. 09/056,999, filed on Apr. 8, 1998, now abandoned.

(30) Foreign Application Priority Data

Apr. 15, 1997 (JP) ..... 9-97594

(51) Int. Cl.[7] ..... B21K 1/14

(52) U.S. Cl. ..... 29/890.14; 29/890.144; 72/348

(58) Field of Search ..... 29/890.14, 890.144; 123/470; 72/333, 334, 348

(56) References Cited

U.S. PATENT DOCUMENTS

| | | | | |
|---|---|---|---|---|
| 927,311 | * | 7/1909 | Anderson | 72/333 |
| 3,372,569 | * | 3/1968 | Bozek | 72/334 |
| 4,414,836 | * | 11/1983 | Saunders | 72/348 |
| 4,489,584 | * | 12/1984 | Gall et al. | 72/333 |
| 5,072,710 | * | 12/1991 | Washizu | 123/470 |
| 5,136,999 | * | 8/1992 | Bassler et al. | 123/490 |
| 5,301,647 | * | 4/1994 | Lorraine | 123/470 |
| 5,448,832 | * | 9/1995 | Kanemitsu et al. | 72/333 |
| 5,492,001 | * | 2/1996 | Sasaki et al. | 72/333 |
| 5,641,126 | * | 6/1997 | Nally et al. | 239/575 |
| 5,735,163 | * | 4/1998 | Sato et al. | 72/348 |
| 5,761,949 | * | 6/1998 | Dalessandro et al. | 72/334 |
| 5,803,052 | * | 9/1998 | Lorraine et al. | 123/470 |

* cited by examiner

*Primary Examiner*—I Cuda Rosenbaum
*Assistant Examiner*—T. Nguyen
(74) *Attorney, Agent, or Firm*—Ladas & Parry

(57) ABSTRACT

A method for producing a connector for a fuel injection nozzle of an internal combustion engine and a method of producing the connector at a reduced cost are disclosed wherein the connector has light weight and exhibits excellent dimensional accuracy. The connector 20 includes a cylindrical fuel injection nozzle fitting portion 21 of which one end is designed to have a flared peripheral surface 23 and of which the other end includes a delivery pipe connecting portion 22 having a diameter smaller than that of the cylindrical fuel injection nozzle fitting portion 21. A plate-shaped position determining portion 24 is formed integral with the flared peripheral surface 23 of the cylindrical fuel injection nozzle fitting portion 21 at a predetermined position. The position determining portion 24 is for determining the position of the connector relative to the fuel injection nozzle and is angularly bent relatively to the injection nozzle fitting portion. The connector is made entirely of a sheet metal.

4 Claims, 8 Drawing Sheets

CONNECTOR FOR FUEL INJECTION NOZZLE AND METHOD OF PRODUCING THE SAME

This is a divisional of application Ser. No. 09/056,999 filed on Apr. 8, 1998, now abandoned.

BACKGROUND OF THE INVENTION

The present invention relates to a connector for a fuel injection nozzle and a method of producing the same. More particularly, the present invention relates to a connector for a fuel injection nozzle usable for a motor-vehicle and a method of producing the same.

An internal combustion engine is known which includes a fuel delivery pipe to which a connector for a fuel injection nozzle is attached. An example of such an engine is illustrated in FIG. 15. In FIG. 15, reference numeral 2 denotes a cylinder block of an engine 1 in which a cylinder bore 3 is formed and a piston 4 is slidably disposed for reciprocation in the cylinder bore 3. A cylinder head 5 is arranged on the upper part of the cylinder bore 3, and an ignition plug 6 and suction valves 7 are disposed on the cylinder head 5. A suction manifold 8 is connected to the cylinder head 5 in a lateral direction, and a fuel injection nozzle 9 is slantwise attached to the upper part of the suction manifold 8.

As shown in FIG. 16 and FIG. 17, a delivery pipe 11 is connected to the fuel injection nozzle 9 via a connector 10 for the fuel injection nozzle 9. As shown in FIG. 15 to FIG. 18, the delivery pipe 11 has a rectangular cross-sectional shape, and one end thereof is closed and the other end has a conduit 12 connected thereto. Holes 13 are formed on the lower surface of the delivery pipe 11, and the connector 10 as shown in FIG. 19 and FIG. 20 is fitted into each of the holes 13 so that fuel can be fed into the fuel injection nozzle 9 via the delivery pipe 11 and the connector 10.

As shown in FIG. 19 and FIG. 20, the connector 10 includes a cylindrical fuel injection nozzle fitting portion 14 having an enlarged diameter and a delivery pipe connecting portion 15 having a reduced diameter and formed integrally with the fuel injection nozzle fitting portion 14. Each of the fuel injection nozzle fitting portion 14 and the delivery pipe connecting portion 14 is formed from a steel material by machining. An outwardly projecting position determining member 16 having a rectangular sectional shape is welded to the outer peripheral surface of the fitting portion 14, and the fuel injection nozzle 9 and the delivery pipe 11 are connected at predetermined positions by fitting the position determining member 16 into a recess in a main body of the fuel injection nozzle 9 and by fitting the connecting portion 15 into the hole 13 of the delivery pipe 11, whereby the fuel fed from the fuel injection nozzle 9 can be injected into the internal combustion engine 1 at a high efficiency.

In the conventional connector 10 as described above, the position determining member 16 is first fabricated from a steel material such as a round rod by the steps of machining, finishing and press-working and then welded to the injection nozzle fitting portion 14. For this reason, the material cost and working cost required for producing the connector 10 are unavoidably increased, and there is a further problem in that the thickness and weight of the convectional connector 10 cannot be reduced as desired due to a limitation to the machining operation. To eliminate these problems, it is thinkable to fabricate the connector from a steel sheet material subjected to deep drawing, but in this case other problems occur such as low dimensional accuracy, low productivity induced by deformation of the connector 10 due to thermal stress generated by subsequent welding or soldering of the position determining member to the connector.

SUMMARY OF THE INVENTION

The present invention has been made in consideration of the above stated problems, and the object of the present invention is to provide a connector for a fuel injection nozzle and a method of producing the same, wherein the connector has light weight and exhibits excellent dimensional accuracy, and moreover, it can be produced at low cost.

According to an aspect of the present invention, there is provided a connector for a fuel injection nozzle of an internal combustion engine, wherein the connector comprises a cylindrical fuel injection nozzle fitting portion having at one end thereof a flared portion diverging away from the fitting portion; a plate-shaped position determining portion formed integral with the fuel injection fitting portion at a predetermined position and extending outwardly from the flared portion, the plate-shaped position determining portion being bent outwardly to form an angle to an outer surface of the fuel injection nozzle fitting portion; and a delivery pipe connecting portion formed at another end of the cylindrical fitting portion having a diameter smaller than that of the cylindrical fitting portion.

According to another aspect of the present invention, there is provided a method of producing a connector for a fuel injection nozzle of an internal combustion engine, wherein the method comprises the steps of preparing an intermediate integral sheet metal product comprising a cylindrical fuel injection nozzle fitting portion including a bottom portion and a flared portion on an opposite side relative to the bottom portion of the cylindrical fitting portion by plastically forming a metal sheet blank; forming a delivery pipe connecting portion projecting outward from the bottom portion of the intermediate product to form a reduced diameter-cylindrical flange on the bottom portion; press-trimming the flared portion with the use of a forming die to give a predetermined diameter to the flared portion; integrally forming an outwardly projecting plate-shaped position determining portion on the flared portion when performing the press-trimming; and bending the position determining portion toward the cylindrical fitting portion.

According to a further aspect of the present invention, there is provided a method of producing a connector for a fuel injection nozzle of an internal combustion engine, wherein the method comprises the steps of firmly holding a metal sheet blank on a conical surface of a hole of a first die, which hole has a diameter corresponding to an outer diameter of a fuel injection nozzle fitting portion of the connector, the conical surface portion being formed successive to the hole; providing a first punch including a first rod-shaped portion having a diameter smaller than that of the hole, and a truncated-conical surface portion formed around a proximal end of the rod-shaped portion; plunging the first punch into the first die to cause the rod-shaped portion thereof to move into the hole of the first die and to cause the truncated-conical surface portion to move against the conical surface portion of the first die, thereby obtaining an intermediate product with the fuel injection nozzle fitting portion formed in the hole, an integral flared portion of the connector formed between the conical surface portion and the truncated-conical portion, and a bottom portion of the fuel injection nozzle fitting portion; forming a hole in the bottom portion of the thus formed fuel injection nozzle fitting portion; forming a delivery pipe connecting portion including a cylindrical flange extending outward from an area of the bottom portion around the hole; trimming the flared portion to give a predetermined diameter to the flared portion and to form a plate-shaped position determining portion extending radially outward from the trimmed flared portion; and bending the plate-shaped position determining portion toward an outer surface of the cylindrical fuel injection nozzle fitting portion.

DESCRIPTION OF THE PREFERRED EMBODIMENTS

Figure 1:
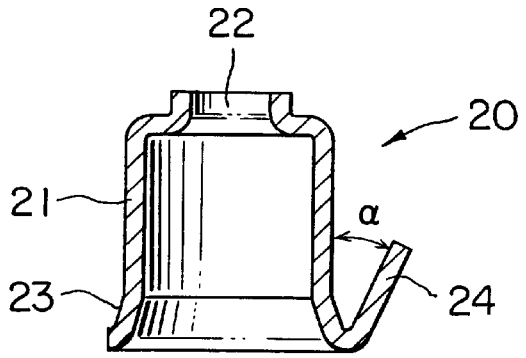
FIG. 1 is a vertical sectional view of an embodiment of a connector for a fuel injection nozzle constructed in accordance with the present invention.

An embodiment of the present invention will first be described in detail below with reference to FIG. 1 to FIG. 3 which show a connector for a fuel injection nozzle constructed in accordance with the present invention. It should be noted that description of some of the same structural components as those of the conventional connector is omitted for the purpose of simplification.

A connector 20 for a fuel injection nozzle includes a fuel injection nozzle fitting portion 21, a delivery pipe connecting portion 22 formed integrally with the fitting portion 21, and a position determining portion 24 projecting radially outward from a peripheral surface 23 of the fitting portion 21.

Figure 2:
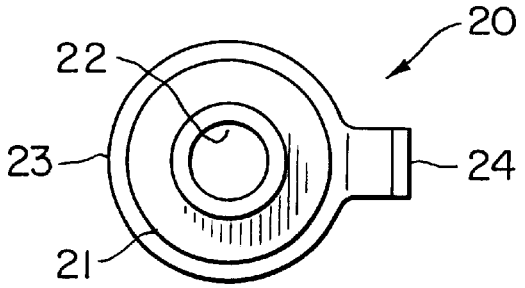
FIG. 2 is a plan view of the connector shown in FIG. 1.
Figure 16:
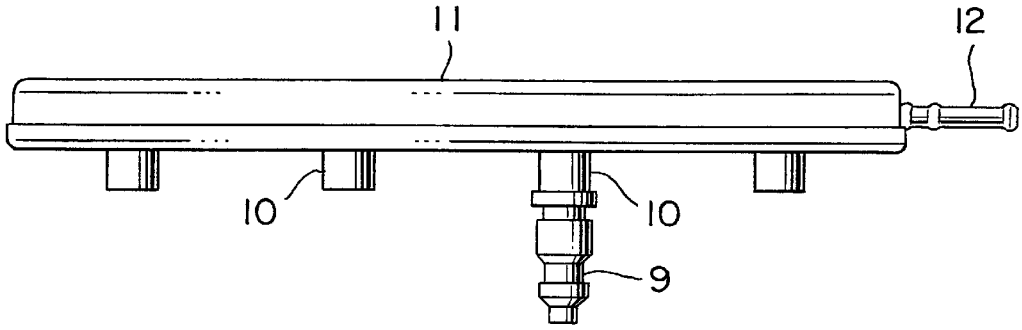
FIG. 16 PRIOR ART
FIG. 16 is an illustrative view showing a state in which a fuel injecting nozzle is attached to a connector disposed on a delivery pipe in the engine of FIG. 15.
Figure 17:
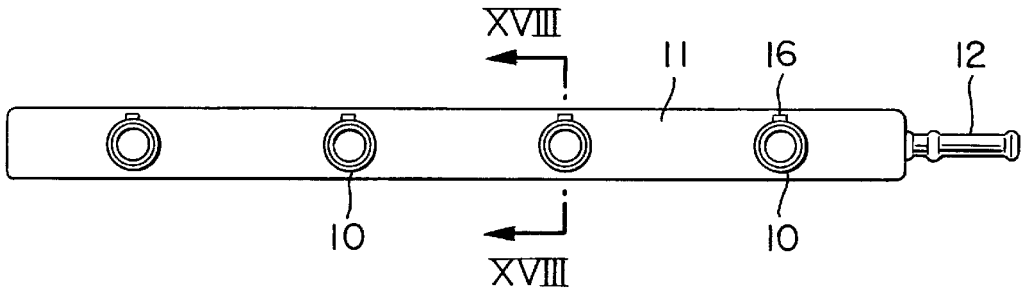
FIG. 17 PRIOR ART
FIG. 17 is an illustrative view of the delivery pipe as seen from below to show the state in which a plurality of connectors are attached to the delivery pipe.
Figure 18:
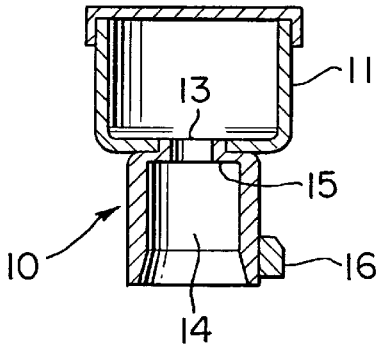
FIG. 18 PRIOR ART
FIG. 18 is a vertical sectional view of a conventional connector taken along a line XVIII—XVIII in FIG. 17 to show the state in which the conventional connector is attached to the delivery pipe.
Figure 19:
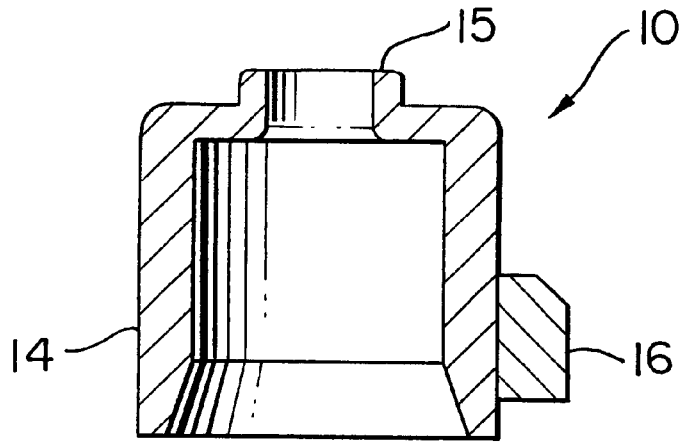
FIG. 19 PRIOR ART
FIG. 19 is a vertical sectional view of the conventional connector.
Figure 20:
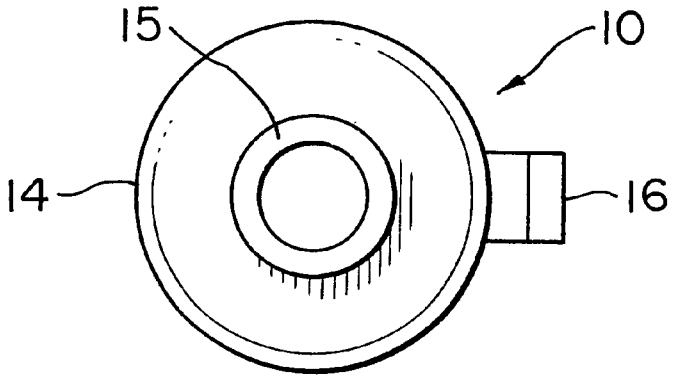
FIG. 20 PRIOR ART
FIG. 20 is a plan view of the conventional connector shown in FIG. 19.

As shown in FIG. 1, the fitting portion 21 is constructed from a cylindrical member made of a steel sheet plate, and the peripheral surface 23 is formed to have a flared shape at one end of the fitting portion 21. A fuel injection nozzle as shown at 9 in FIG. 16 is inserted or fitted into the inner peripheral surface of the fitting portion 21. As shown in FIG. 1 and FIG. 2, the rectangular plate-shaped position determining portion 24 projects outwardly from the peripheral surface 23 and integrally with the fitting portion 21. This position determining portion 24 is bent at an angle $\alpha$ with the outer surface of the fitting portion 21 and extends obliquely along the outer surface of the fitting portion 21. The angle $\alpha$ is an acute angle in the embodiment shown in FIG. 1, but the angle $\alpha$ may be an obtuse angle or a right angle. This position determining portion 24 is fitted into a recess (to be described later) formed on the fuel injection nozzle in such a manner that the inserting position of the fuel injecting nozzle relative to the connector 20 is maintained at a predetermined position at all times without any adverse effect on the performance of the internal combustion engine. The delivery pipe connecting portion 22 is formed on the opposite side of the peripheral surface 23 and is caused to have a diameter smaller than that of the fitting portion 21 by drawing operation performed thereon.

Figure 3:
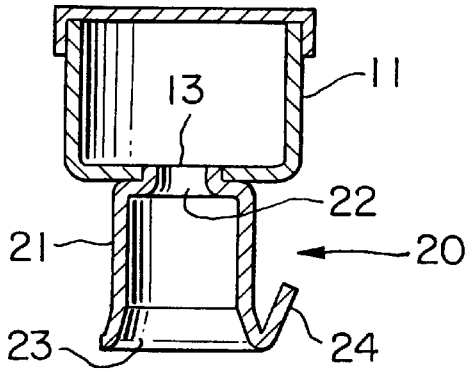
FIG. 3 is a vertical sectional view showing a state in which the connector is connected to a delivery pipe.

As shown in FIG. 3, the delivery pipe connecting portion 22 is fitted into a hole 13 provided in the lower surface of a delivery pipe 11, whereby the connector 20 is connected to the delivery pipe 11 via the delivery pipe connection portion 22.

Next, an example of method of producing a connector for a fuel injection nozzle in accordance with the present invention will be described below with reference to FIG. 4 to FIG. 14.

Figure 4:
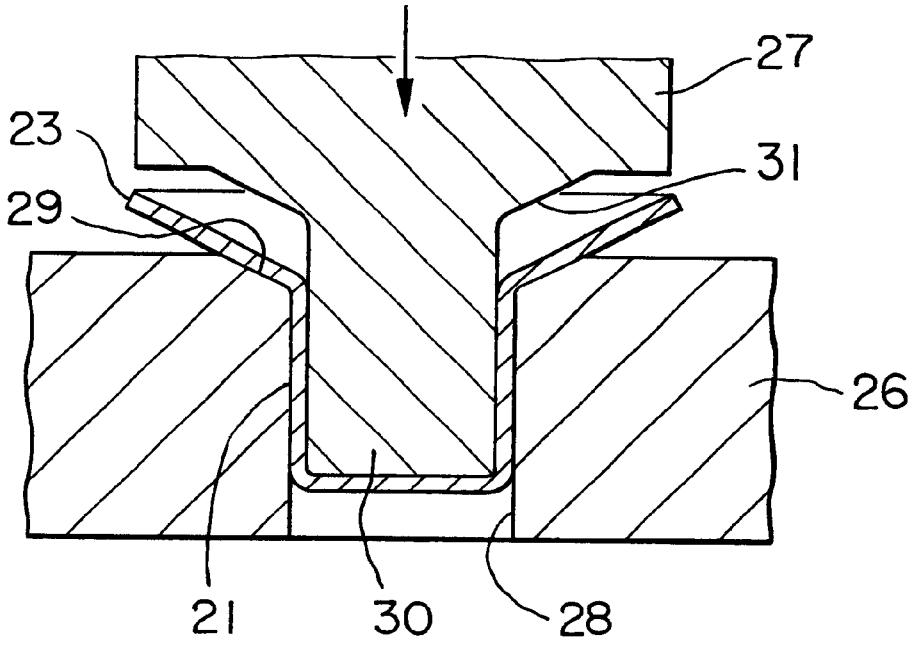
FIG. 4 is an illustrative sectional view showing a state in which a blank is subjected to drawing treatment with the use of a first die and a first punch.
Figure 5:
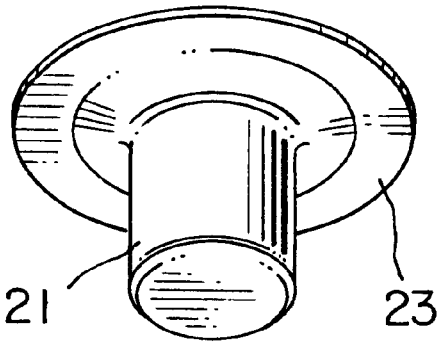
FIG. 5 is a perspective view showing a cylindrical fitting portion of the connector.

As shown in FIG. 4, the fuel injection nozzle fitting portion 21 is produced with the use of a first die 26 and a first punch 27. The first die 26 has therethrough a hole 28 having a diameter corresponding to the outer diameter of the fitting portion 21, and additionally, a conical surface portion 29 formed at one end part of the hole 28, the conical surface portion 29 corresponding to the flared peripheral surface 23 of the fitting portion 21. The first punch 27 has a first rod-shaped portion 30 corresponding to the inner diameter of the fitting portion 21 and a truncated conical surface portion 31 corresponding to the conical surface portion 29 of the first die 26. While a metal sheet, e.g., a steel sheet is immovably held on the first die 26, the first punch 27 is caused to descend in the arrow-marked direction by driving a press machine (not shown), causing the steel sheet to be pressed and drawn within the first die 26, whereby the fitting portion 21 with the flared peripheral surface 23 is formed from the steel sheet due to the drawing operation performed, as shown in FIG. 5.

Figure 6:
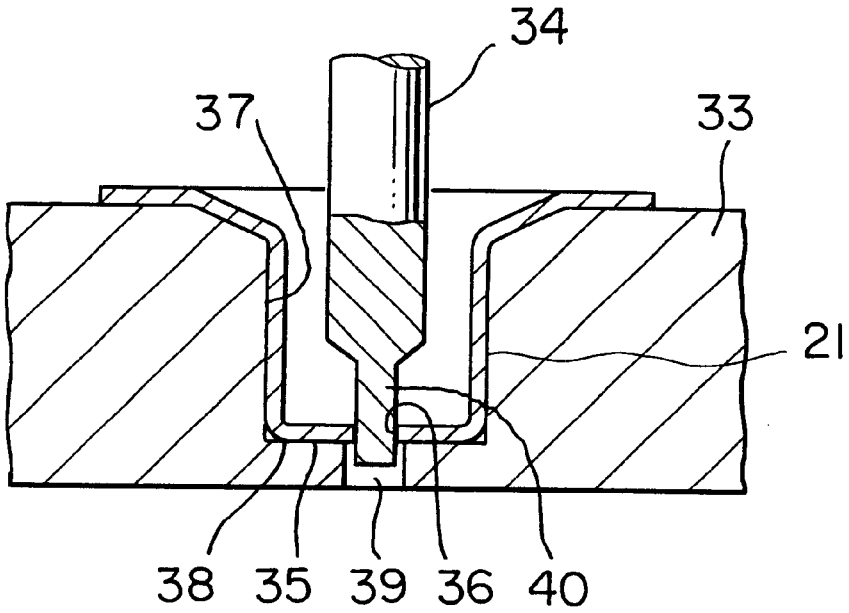
FIG. 6 is an illustrative sectional view showing a state in which a blank is subjected to drawing treatment with the use of a second die and a second punch.
Figure 7:
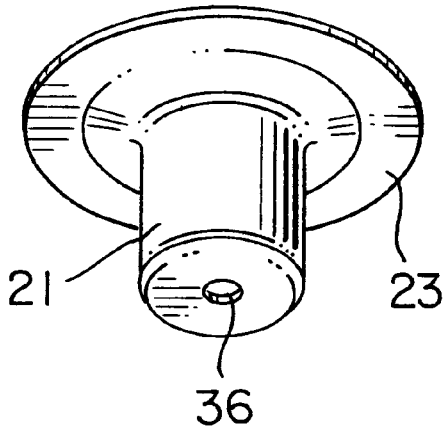
FIG. 7 is a perspective view showing a lower hole formed through the bottom of the cylindrical fitting portion.

Next, a hole 36 (FIG. 7) for forming the delivery pipe connecting portion 22 on the bottom 35 of the fitting portion 21 is formed with the use of a second die 33 and a second punch 34 as shown in FIG. 6. A cylindrical recess 37 having dimensions corresponding to the outer diameter and the depth of the fitting portion 21 is formed through the central part of the second die 33, and moreover, a small hole 39 is formed through a bottom portion 38 of the cylindrical recess 37. The second punch 34 has a second rod-shaped portion 40 having a diameter smaller than that of the small hole 39. With this construction, a lower hole 36 for the delivery pipe connecting portion 22 is formed through the bottom 35 of the fitting portion 21 as shown in FIG. 7, by placing the fitting portion 21 into the cylindrical recess 37 of the second die 33 and causing the bottom portion 35 of the fitting portion 21 to be punched with the second rod-shaped portion 40 of the second punch 34.

Figure 8:
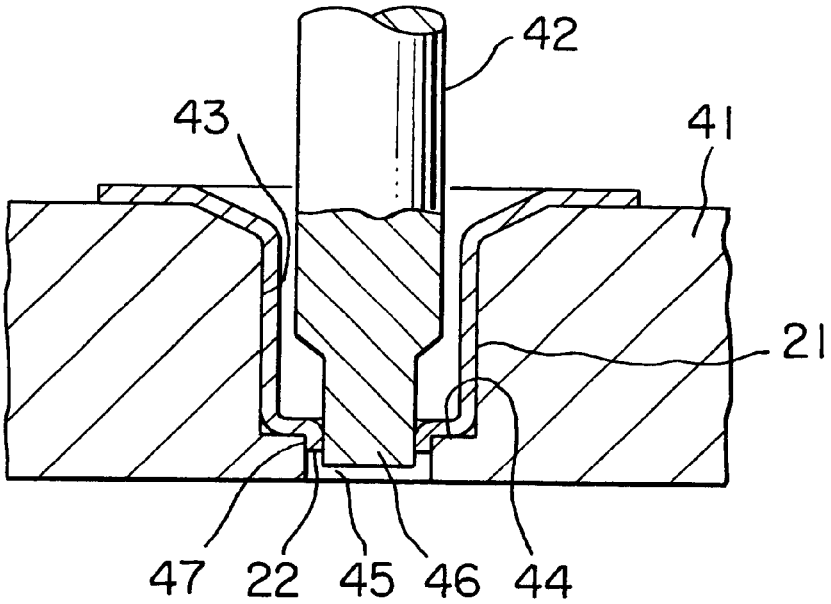
FIG. 8 is an illustrative sectional view showing a state in which a blank is subjected to drawing treatment with the use of a third die and a third punch.
Figure 9:
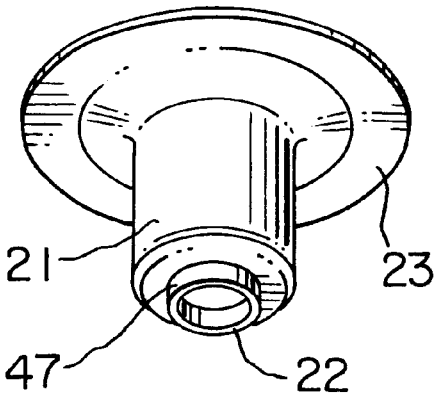
FIG. 9 is a perspective view showing a state in which a delivery pipe connecting portion is formed on the cylindrical fitting portion.

Next, the delivery pipe connecting portion 22 with a reduced diameter is formed in the area of the lower hole 36 of the fitting portion 21 with the use of a third die 41 and a third punch 42 as shown in FIG. 8. A cylindrical recess 43 having dimensions corresponding to the outer diameter and the depth of the fitting portion 21 is formed in the third die 41, and a shaping hole 45 having a diameter larger than that of the hole 36 is formed through the central part of a bottom portion 44 of the cylindrical recess 43. On the other hand, a third rod-shaped portion 46 having a diameter smaller than that of the shaping hole 45 is formed on the third punch 42. With this construction, an annular flange 47 projecting from the bottom 35 of the fitting portion 21 is formed in the area of the peripheral surface of the hole 36, by placing the fitting portion 21 into the cylindrical recess 43 of the third die 41 and causing the area around the hole 36 to be pushed and shaped plastically with the third rod-shaped portion 46 of the third punch 42, whereby the delivery pipe connecting portion 22 including the flange 47 is formed on the fitting portion 21 as shown in FIG. 9.

Figure 10:
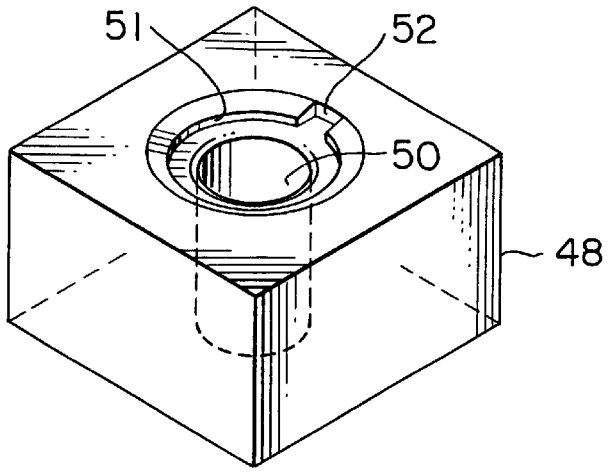
FIG. 10 is a perspective view showing the contour of a drawing die.
Figure 11:
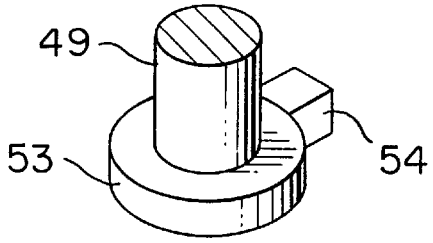
FIG. 11 is a perspective view showing the contour of a drawing punch.

Finally, an outer diameter part trimming operation is performed as shown in FIG. 10 and FIG. 11, with the use of a forming die 48 and a forming punch 49 so as to allow a predetermined outer diameter of the fitting potion 21 to be formed by the forming die 48 and the forming punch 49, and moreover, the position determining portion 24 is formed and stamped integral with the fitting portion 21. Thus, the flared peripheral surface 23 is precisely formed to assume a predetermined contour.

Figure 12:
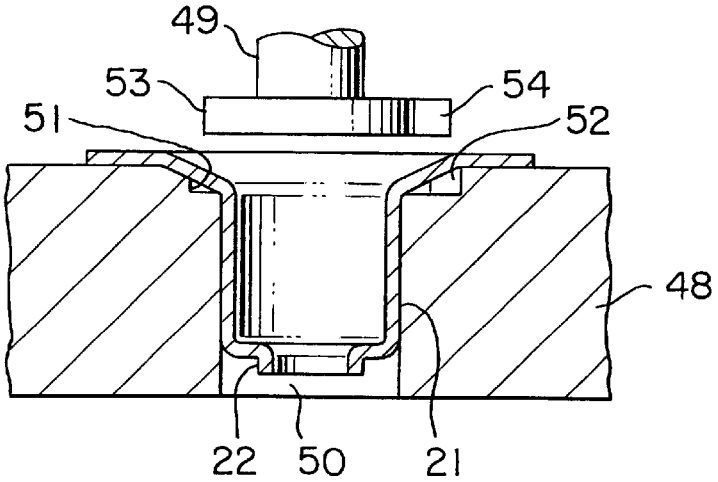
FIG. 12 is an illustrative sectional view showing a state in which a blank is subjected to drawing treatment using the drawing die and the drawing punch shown in FIG. 10 and FIG. 11.

As shown in FIG. 10 and FIG. 12, the forming die 48 has a hole 50 for receiving the fitting portion 21, an annular recess 51 corresponding in shape to the flared peripheral surface 23, and an outwardly extending recess 52 corresponding in shape to the position determining portion 24 projecting from the peripheral surface 23. The recess 52 is disposed in continuation with the recess 52.

Figure 13:
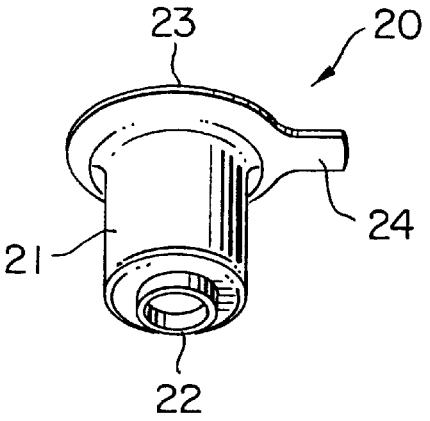
FIG. 13 is a perspective view showing a position determining portion and a delivery pipe connecting portion formed on the cylindrical fitting portion.
Figure 14:
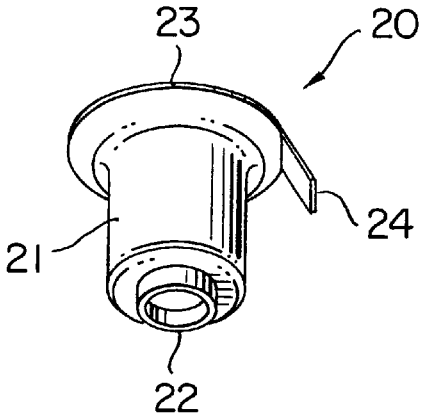
FIG. 14 is a perspective view showing a connector for which a drawing operation is completed with the blank.
Figure 15:
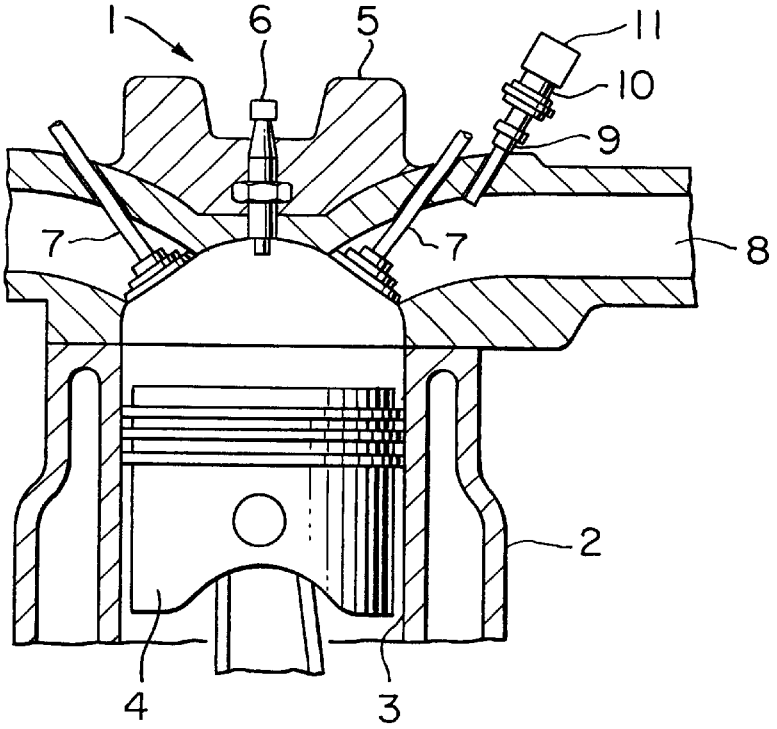
FIG. 15 PRIOR ART
FIG. 15 is a fragmentary vertical sectional view of a known internal combustion engine.

As shown in FIG. 11 and FIG. 12, the forming punch 49 includes a pressing portion 53 corresponding in shape to the recess 51 and an outwardly extending rectangular pressing portion 54 corresponding in shape to the recess 52 for forming the position determining portion 24. With such construction, the flared peripheral surface 23 is formed to assume a predetermined diameter and a predetermined conical contour, and moreover, the rectangular plate-shaped position determining portion 24 is formed as shown in FIG. 13, by causing the fitting portion 21 to be placed into the hole 50 and causing the flared peripheral surface 23 to be pressed with the descending forming punch 49. Thereafter, the position determining portion 24 is bent toward the side of the outer surface of the fitting portion 21, whereby production of the connector 20 is completed as shown in FIG. 14.

It should be noted that all the above operations are automatically performed with the aid of computer control.

As is apparent from the above description, according to the present invention, there is provided a connector for a fuel injection nozzle, which is constructed to have a cylindrical fuel injection nozzle fitting portion of which one end is press-formed to exhibit a flared contour, a plate-shaped position determining portion bent outwardly of the flared peripheral surface of the fuel injection nozzle fitting portion, formed integral with the fuel injection nozzle fitting portion, and a delivery pipe connecting portion having a diameter smaller than that of the fuel injection nozzle fitting portion and formed at the other end of the fitting portion. Thus, the connector has light weight and exhibits excellent dimensional accuracy without any necessity for machining operations and without any thermal deformation induced by welding or the like. Further the connector can be produced at a reduced cost.

Furthermore, the method of producing a connector for a fuel injection nozzle according to the present invention is practiced by press-forming a sheet blank with the use of dies and punches, connectors having a constant dimensional accuracy can be produced at high efficiency on a mass production line. Consequently, connectors can be provided at low cost.

While the present invention has been described above with respect to preferred embodiments thereof, it should be understood that it is not limited only to the embodiment but various change or modification may be made without departure from the scope of the invention as defined by the appended claims.

What is claimed is:

1. A method of producing a connector for a fuel injection nozzle of an internal combustion engine, comprising the steps:

firmly holding a metal sheet blank on a conical surface portion of a first die hole of a first die, wherein said first die hole has a diameter corresponding to an outer diameter of a fuel injection nozzle fitting portion of said connector, said conical surface portion being formed successive to said first die hole;

providing a first punch including a first rod-shaped portion having a diameter smaller than that of said first die hole, and a truncated-conical surface portion formed around a proximal end of the rod-shaped portion;

plunging said first punch into said first die to cause the rod-shaped portion thereof to move into said first die hole of the first die and to cause said truncated-conical surface portion to move towards said conical surface portion of the first die thereby obtaining an first intermediate product having said fuel injection nozzle fitting portion formed in said first die hole, an integral flared portion of the connector formed between said conical surface portion and said truncated-conical surface portion, and a bottom portion of the fuel injection nozzle fitting portion;

forming a hole in said bottom portion of the thus formed fuel injection nozzle fitting portion thereby obtaining a second intermediate product;

forming a delivery pipe connecting portion including a cylindrical flange extending outward from an area of said bottom portion around said hole in said bottom portion thereby obtaining a third intermediate product;

trimming said flared portion to give a predetermined diameter to the flared portion and to form a plate-shaped position determining portion extending radially outward from the trimmed flared portion; and bending the plate-shaped position determining portion toward an outer surface of the fuel injection nozzle fitting portion.

2. The method according to claim 1, wherein said step of forming a hole is performed by fitting said first intermediate product into a cylindrical recess of a second die and advancing a second punch into a second die hole formed in a bottom of said cylindrical recess.

3. The method according to claim 1, wherein said step of forming a delivery pipe connecting portion is performed by fitting said second intermediate product obtained as a result of said step of forming a hole, into a cylindrical recess of a third die and advancing a third punch against said bottom portion of the fuel injection nozzle fitting portion.

4. The method according to claim 1, wherein said step of trimming is performed by fitting said third intermediate product obtained as a result of said step of forming a delivery pipe, into a fourth die having a product receiving recess with an annular recess corresponding in shape to said flared portion and a radially outwardly extending recess corresponding in shape to said plate-shaped position determining portion, and by plunging into said a fourth punch a fourth punch having an annular pressing portion corresponding in shape to said annular recess and a radially outwardly extending pressing portion corresponding in shape to said radially outwardly extending recess.

* * * * *